US006890893B2

(12) United States Patent
Datta

(10) Patent No.: US 6,890,893 B2
(45) Date of Patent: May 10, 2005

(54) LOW ODOR COMPOSITION FOR LACTATE ESTERS AND OTHER ESTER BIOSOLVENTS

(75) Inventor: Rathin Datta, Chicago, IL (US)

(73) Assignee: Vertec BioSolvents, Inc., Downers Grove, IL (US)

( * ) Notice: Subject to any disclaimer, the term of this patent is extended or adjusted under 35 U.S.C. 154(b) by 297 days.

(21) Appl. No.: 10/218,922

(22) Filed: Aug. 14, 2002

(65) Prior Publication Data

US 2003/0036495 A1 Feb. 20, 2003

Related U.S. Application Data

(60) Provisional application No. 60/312,157, filed on Aug. 14, 2001.

(51) Int. Cl.[7] ..... C11D 7/50; C11D 7/26

(52) U.S. Cl. ..... 510/407; 510/174; 510/212; 510/245; 510/365; 510/417; 510/505; 510/506; 134/38

(58) Field of Search ..... 510/174, 212, 510/245, 365, 407, 417, 505, 506; 134/38

(56) References Cited

U.S. PATENT DOCUMENTS 3,954,648 A 5/1976 Belcak et al.
5,215,675 A * 6/1993 Wilkins et al. ..... 510/206
5,346,652 A * 9/1994 Dotolo et al. ..... 510/118
5,437,808 A * 8/1995 Weltman et al. ..... 510/407
5,464,555 A * 11/1995 Bayless ..... 510/174
6,096,699 A * 8/2000 Bergemann et al. ..... 510/201
6,191,087 B1 2/2001 Opre et al.
6,284,720 B1 9/2001 Opre
6,395,103 B1 * 5/2002 Machac et al. ..... 134/40

* cited by examiner

*Primary Examiner*—Gregory Webb
(74) *Attorney, Agent, or Firm*—Welsh & Katz,Ltd.

(57) ABSTRACT

A solvent composition that comprises a $C_1$–$C_4$ lactate ester and an odor-reducing amount of a tertiary amine having a boiling point at one atmosphere of about 80° C. to about 160° C. is disclosed. The composition (a) is substantially free of odor due to the tertiary amine, (b) exhibits a reduced amount of odor due to the lactate ester as compared to the same composition without the tertiary amine, and (c) is a homogeneous liquid or gel at zero degrees Celsius. A method of reducing the odor of a lactate ester-based solvent is also disclosed.

39 Claims, No Drawings

LOW ODOR COMPOSITION FOR LACTATE ESTERS AND OTHER ESTER BIOSOLVENTS

CROSS-REFERENCE TO RELATED APPLICATION

The present patent application is a continuation of U.S. Provisional Patent Application Ser. No. 60/312,157 filed on Aug. 14, 2001, for which the benefit of the priority filing date is claimed under 35 U.S.C. 119(e).

BACKGROUND ART

Ethyl Lactate and other lactate esters are environmentally benign, non-toxic solvents obtained from renewable carbohydrates via fermentation and separations processes. Ethyl lactate for example, has very good solvent properties and a characteristic odor.

Lactate esters can be blended with fatty acid esters and other ester containing solvents to provide biosolvent blends with enhanced solvating, cleaning and penetration properties. For example in U.S. Pat. Nos. 6,096,699 and 6,191,087 teach that lactate esters such as ethyl lactate blended with fatty acid esters such as methyl esters of soy oil fatty acids can be used for a variety of solvent cleaning, metal degreasing, paint and varnish removal applications. Allowed, co-assigned U.S. application Ser. No. 09/544,756 teaches that lactate esters and fatty acid esters can also be blended with dibasic esters such as dimethyl succinate, dimethyl adipate and glutarate and various surfactants to provide solvent cleaners that are particularly effective in cleaning printing machinery.

It has been noted that lactate esters can emit an odor whose perception and tolerance over time can inhibit commercial acceptance of products containing such esters. In some recent tests conducted with ethyl lactate solvent samples obtained from various manufacturers, it was found that the source and manufacturing processes did not have a significant impact on the odor perception. The test subjects, however, mentioned that the odor perception lingered and became more biting and irritating as the duration of their smelling increased. Anecdotal of an increase in the bite/irritation sensation with the duration of the use of lactate esters as well as other ester-based solvent blends have been reported. Thus, overcoming this irritation sensation could be important to the widespread acceptance of the lactate ester biosolvents.

Masking lactate ester solvent odor by addition of perfume components, by using citrus oil-based d-limonene and other solvent diluents has been attempted. In many cases such masking reduced the problem but only by a large amount of dilution of the lactate esters. However, because lactate esters have excellent solvating properties, dilution typically leads to reduction in performance. Furthermore, many applications require that the lactate esters be in high concentrations in the formulations. It would therefore be beneficial if the odors associated with the use of lactate esters could be abated or otherwise alleviated. The disclosure that follows provides one solution for alleviating the odors associated with lactate ester compositions.

BRIEF SUMMARY OF THE INVENTION

It has been found that addition of small amounts of certain tertiary amines to lactate esters and ester solvent blends (compositions) enhances the odor tolerance and reduces or eliminates the lingering bite/irritation sensation that appears after long or continuous exposure to those solvents. Thus, the present invention contemplates a solvent composition that comprises a $C_1$–$C_4$ lactate ester and an odor-reducing amount of a tertiary amine having a boiling point at one atmosphere of about 80° C. to about 160° C., and preferably about 130° C. to about 160° C. The composition (a) is substantially free odor due to the tertiary amine, (b) exhibits a reduced amount of odor due to the lactate ester as compared to the same composition without the tertiary amine, and (c) is a homogeneous liquid or gel at zero degrees C.

A method of reducing the odor of a lactate ester-based solvent is also contemplated. In accordance with this method, an odor-reducing amount of a tertiary amine having a boiling point at one atmosphere of about 80° C. to about 160° C., and preferably about 130° C. to about 160° C., is homogeneously admixed into a $C_1$–$C_4$ lactate ester-containing solvent composition. The resulting composition (a) is substantially free odor due to the tertiary amine, (b) exhibits a reduced amount of odor due to the lactate ester as compared to the same composition without the tertiary amine, and (c) is a homogeneous liquid or gel at zero degrees C.

The present invention has several benefits and advantages.

One benefit is that the potential problem associated with the odor of lactate ester-containing solvent compositions can be substantially reduced if not eliminated.

An advantage of the invention is that the potential odor problem can be dealt with using readily available chemicals whose presence do not negatively impact the solvating characteristics of the solvent composition.

Another benefit of the invention is that the potential odor problem associated with the use of lactate ester-containing solvent compositions can be dealt with inexpensively.

Still further benefits and advantages of the present invention will be apparent to the skilled worker from the disclosure that follows.

DETAILED DESCRIPTION OF THE INVENTION

The present invention in one aspect contemplates a solvent composition that comprises a $C_1$–$C_4$ lactate ester and an odor-reducing amount of a tertiary amine having a boiling point at one atmosphere of about 80° C. to about 160° C. The composition (a) is substantially free of odor due to the tertiary amine, (b) exhibits a reduced amount of odor due to the lactate ester, (c) and is a homogeneous liquid or gel at zero degrees C. A contemplated composition is typically used as a solvent for cleaning and degreasing applications, as a paint stripper, an ink remover, or the like.

A contemplated solvent composition is substantially free of odor due to the tertiary amine. Thus, the solvent composition can and often does have an odor. However, that odor is typically not that of the added tertiary amine, or when a tertiary amine odor is present, that odor is not offensive to an ordinary person using the composition even when continuously breathing the vapor. Similarly, the odor perceived is typically not that of the lactate ester, although some of that odor can be present. Rather, the perceived lactate ester odor is reduced relative to the odor present due to the lactate ester alone or lactate ester admixed with one or more ingredients other than the tertiary amine.

A contemplated solvent composition is a homogeneous liquid or gel at zero degrees C. As a consequence, the composition does not separate into a plurality of phases, e.g. solid/liquid or liquid/liquid, at that temperature.

One embodiment of a $C_1$–$C_4$ lactate ester-containing solvent composition contemplated for use here includes substantially pure $C_1$–$C_4$ lactate ester so that the solvent composition can contain up to about 99 weight percent lactate ester. When additional ingredients are present in such a composition, those ingredients preferably include a $C_1$–$C_4$ ester of a $C_{16}$–$C_{20}$ fatty acid having a melting point on minus 10° C. or less.

In other embodiments, considerably lesser amounts of the lactate ester can be present as are disclosed in co-assigned U.S. Pat. Nos. 6,096,699 and 6,191,087 and allowed, co-assigned U.S. application Ser. No. 09/544,756.

Thus, for example, a lactate ester can comprise about 20 to about 75 weight percent of the composition. Such a composition preferably further comprises about 10 to about 60 weight percent of a $C_1$–$C_4$ ester of a $C_{16}$–$C_{20}$ fatty acid having a melting point on minus 10° C. or less.

In another embodiment, the lactate ester comprises about 30 to about 60 weight percent of the solvent composition. Here, the composition preferably further comprises about 30 to about 60 weight percent of a $C_1$–$C_4$ ester of a $C_{16}$–$C_{20}$ fatty acid having a melting point on minus 10° C. or less.

In yet another embodiment, the lactate ester comprises about 40 to about 70 weight percent of the composition. Here, it is preferred that the composition further comprise about 1 to about 30 weight percent of a $C_1$–$C_4$ ester of a $C_{16}$–$C_{20}$ fatty acid having a melting point on minus 10° C. or less. Here, more preferably, the composition comprises about 40 to about 70 weight percent of the solvent composition and the $C_1$–$C_4$ ester of a $C_{16}$–$C_{20}$ fatty acid comprises about 1 to about 30 weight percent of the composition.

It is most preferred that the $C_1$–$C_4$ lactate ester be ethyl lactate, a $C_2$ lactate ester.

A contemplated solvent composition can also include further ingredients such as an organic co-solvent, a surfactant, an acidulent, a thickener or gelling agent, and an emulsifying agent as are noted in the before-mentioned patents and allowed application. The $C_1$–$C_4$ ester of a $C_{16}$–$C_{20}$ fatty acid in a before-described solvent composition is preferably a methyl ester of fatty acids from an edible oil such as soy oil, as is also so mentioned.

Some contemplated solvent compositions are substantially free of added water. Thus, although some water can be present as a result of being an impurity of a constituent, water is typically not added to such a composition, and a composition typically contains 5 weight percent water or less. Other compositions can contain up to about 80 or 90 weight percent water.

The contemplated tertiary amines have some volatility but are not excessively volatile, so that they do not have overwhelmingly high concentration in the vapor such that the odor of the amines, which can also be unpleasant, dominates. The contemplated tertiary amines typically exhibit a low level of toxicity, are readily biodegradable and are commonly used in industrial and consumer products.

A relatively narrow range of tertiary amines is contemplated here. The amines that are particularly suitable have boiling points of about 80° C. to about 160° C. at atmospheric pressure, and more preferably have an atmospheric boiling point of about 130° C. to about 160° C. These tertiary amines also exhibit have moderate vapor pressures at ambient temperatures, but boiling points are usually more readily obtained and are therefore preferably used herein. Some illustrative tertiary amines that are particularly contemplated include N,N-dimethylethanolamine, N,N-diethylethanolamine, 1-dimethylamino-2-propanol, 3-dimethylamino-1-propanol, N-methyl morpholine, N-ethyl morpholine, triethylamine, tripropylamine, triisopropylamine, 1-dimethylamino-2-propyne, triallylamine, 1-methylpyrrolidine, 1-ethylpyrrolidine, pyridine, 2-picoline, 3-picoline, 4-picoline, 2,3-lutidine, 2,4-lutidine, 2,5-lutidine, 2,6-lutidine, 3,4-lutidine and 3,5-lutidine. The aliphatic tertiary amines are preferred, and N,N-Dimethylethanolamine and N,N-diethylethanolamine are particularly referred aliphatic tertiary amines. Use of a single tertiary amine is preferred, but mixtures of two or more tertiary amines are also contemplated.

It has been found that triethanolamine is ineffective for the present invention. Triethanolamine has a much higher boiling point (335.4° C.) than the above-noted range, and also exhibits a low vapor pressure (less than 0.01 at 20° C.). On the other hand, lower boiling tertiary amines such as trimethylamine (boiling point=2.9° C.) are too volatile and provide a substantial, objectionable odor of their own. Primary and secondary amines are not used because they can react with the esters present in the solvent composition.

With out wishing to be bound by theory, this relatively small group of tertiary amines is believed to be effective because their relatively low boiling points and moderate vapor pressures permit small amounts of the tertiary amine to be present in the vapor given off by the ester-containing solvent. When present in those vapors, the tertiary amine can neutralize the lactic acid formed on hydrolysis of the ester in the nasal passages or other odor-detecting organs, thereby reducing the odor of the lactate ester, while exhibiting little if any odor of its own. It was surprising and counterintuitive to find that a tertiary amine that is normally associated with an objectionable odor of its own could be used to reduce the odor of a lactate ester.

As already noted, the tertiary amine is present in an odor-reducing amount. Typically, the contemplated concentration for the tertiary amine is about 1 percent by weight (w/w) to about 25 percent w/w of the esters present with boiling points of less than about 200° C. at atmospheric pressure, and preferably about 2 to about 10 percent w/w, and more preferably about 2 to about 5 percent w/w. Because the densities of a contemplated tertiary amine and lactate ester are both about 0.9 to about 1, weight percentages are very similar to volume percentages and either can be used. Exemplary esters with boiling points of less than about 200° C. include methyl lactate, ethyl lactate, isopropyl lactate, butyl lactate and allyl lactate, whose boiling points at atmospheric pressure range between about 145° C. and about 190° C.

A method for reducing the odor of a $C_1$–$C_4$ lactate ester-containing solvent composition is also contemplated. In accordance with that method, an odor-reducing amount of a tertiary amine having a boiling point at one atmosphere of about 80° C. to about 160° C. is homogeneously admixed with the $C_1$–$C_4$ lactate ester-containing composition to form the solvent composition. Each of the previously discussed preferences for the solvent composition is also a preference for the method.

The admixture between the lactate ester-containing composition and tertiary amine can occur before or after the remaining ingredients of the composition are added. Thus, a lactate ester-containing composition can be prepared as discussed in one of the before-mentioned patents or allowed application, and the tertiary amine homogeneously admixed into the otherwise prepared composition. Alternatively, the amine and lactate ester can be homogeneously admixed and one or more additional ingredients added thereafter. In another alternative, the tertiary amine and a fatty acid ester are first admixed and the lactate ester is homogeneously admixed with the first-prepared admixture.

Assay Procedures

Tests were conducted to assay the odor/irritation tolerance of various solvent compositions using six human volunteers (subjects) that agreed to breathe the vapor from the solvent blend test samples according to a prescribed method and provide their reactions, which were recorded. In carrying out these tests, several drops of the solvent sample were spread on a piece of tissue paper. The subjects held the solvent-treated paper close to their noses (about 3 to 4 inches away) and continually breathed in the vapor as he/she sat at a table or walked around the room. This closeness to the solvent (3–4 inches) was far greater than that usually practiced by a solvent user whose nose normally would be several feet from a solvent-soaked towel or rag. This test therefore exaggerated and artificially shortened the time a user would remain in contact with a lactate ester-containing solvent composition.

From the start of the test, the time for various events or sensations that the subject observed, were recorded. The first observation the subjects reported was a "bite" sensation and the time for this was recorded as the close breathing of the vapor continued. Then, the time for the onset of irritation and the continuing of irritation were noted. Whether the irritation continually increased or stayed at a low level was recorded. If the subject decided to stop the test because of continued and increasing irritation, this time was also noted.

In any case, the breathing test was stopped after 5 minutes, which, for such close and continual breathing of the solvent vapors was considered to be adequate for measure of the irritation level and its mitigation. Between tests of different samples, the subject went away from the room, drank water if desired, breathed fresh air and did other work for about 5 to 10 minutes before coming back for the next sample.

In all the tests and with all the subjects, the tertiary amine addition was found to be effective in reducing the odor of the lactate ester without adding the objectionable odor of the amine itself. In all the tests, the relative duration of the tolerance was remarkably increased and for several amine concentrations and solvent mixtures, the irritation level was either completely mitigated or considered to be tolerable.

EXAMPLE 1

This test was conducted on subjects 1 and 6 with unblended ethyl lactate and N,N-dimethylethanolamine (DMEA). The first sample tested as the control was ethyl lactate solvent available from Vertec Biosolvents as Vertec™ ELS. The ethyl lactate concentration was greater than 99.5 percent. The second sample tested was 10 percent v/v of DMEA (reagent grade from Aldrich Chemical Co.) homogeneously admixed with Vertec™ ELS.

With Sample 1, the ethyl lactate control, subject 1 had the first bite sensation at about 120 seconds, onset of continuing irritation arose at about 210 seconds, and the test was terminated due continued and increasing irritation at about 240 seconds. For subject 6, the first bite sensation was at about 30 seconds, onset of continuing irritation was at about 60 seconds, and the test was terminated due to continuing and increasing irritation at about 120 seconds.

With sample 2, 10 percent v/v DMEA in ethyl lactate, subject 1 had a first bite sensation at about 180 seconds, had no onset of continuing irritation, and the test was not stopped before the maximum time of 300 seconds. For subject 6, the first bite sensation was at about 120 seconds, again there was no onset of continuing irritation, and the test did not have to be terminated for that reason.

These results clearly show the duration of tolerance was clearly increased and the irritation was mitigated by the addition of the small concentration of DMEA. This was true for the two subjects who clearly had different thresholds for their tolerance levels.

EXAMPLE 2

This test was conducted on subjects 1, 2, 3, 4 and 5 with ethyl lactate and differing concentrations of N,N-dimethylethanolamine (DMEA). The first sample tested as the control was ethyl lactate solvent available from Vertec Biosolvents as Vertec™ ELS. The ethyl lactate concentration was greater than 99.5 percent. The other samples tested ranged between 2 percent, 5 percent and 10 percent v/v of DMEA (reagent grade from Aldrich Chemical Co.) mixed in Vertec™ ELS.

With the control ethyl lactate sample, all the subjects had first bite sensation, followed by onset of irritation that continually increased, and all of them terminated the test because of the continued increase in irritation. The termination times ranged from a low of 40 seconds for subject 5 to 210 seconds for subject 1.

The 2 percent w/w concentration of DMEA was tested on subjects 1 and 2. At this level the onset of irritation was delayed by a factor of 1.5 to 2, but the tests had to be terminated because of continued and increasing irritation.

At the 5 percent w/w concentration of DMEA, each of the test subjects 1, 3, 4 and 5 exhibited increased tolerance, and subjects 1 and 4 completed the total duration of the test of 300 seconds without feeling any continued irritation.

At the 10 percent w/w concentration, each of test subjects 1–5 exhibited more and increased tolerance, and subjects 1, 2, 4 and 5 completed the total duration of the test of 300 seconds without feeling any continued and increasing irritation.

The results from this example clearly support that from Example 1 and show that the amine concentration affects the threshold and degree of tolerance.

EXAMPLE 3

This test was conducted on subjects 1, 2, and 5 with 5 percent w/w triallylamine in ethyl lactate as before.

All subjects showed increased tolerance, and time for onset of irritation was increased by 1.5 to 2 fold. Furthermore, subjects 1 and 2 did not find the irritation to be continued or increasing and completed the total test duration of 300 seconds without termination.

The results from this example show that other classes of tertiary amines such as those having unsaturated allyl groups are also effective.

EXAMPLE 4

This test was conducted on subject 1, with 2 percent w/w triethylamine in ethyl lactate that was provided as before.

Once again, the subject showed increased tolerance and time for onset of irritation was increased by 2 fold when the tertiary amine was present compared to the time to irritation in the absence of tertiary amine. Furthermore, the subject did not find the irritation to be continued or increasing, and completed the total test duration of 300 seconds without termination.

The results from this example show that other classes of tertiary amines such as those having saturated ethyl groups are also effective.

EXAMPLE 5

In this test the solvent blend of ethyl lactate with soy methyl ester (methyl esters of soy oil fatty acids) were tested with admixed tertiary amines. The solvent blend that was used was 50 percent w/w ethyl lactate in soy methyl esters that is sold by Vertec Biosolvents under the trade name Vertec™ Gold 50. The control was this Vertec™ Gold 50 and the test sample was 5 percent w/w DMEA in this solvent blend. The test subjects were 1, 2, 3 and 5.

The control, even though it was a 50 percent w/w concentration of ethyl lactate blended into essentially non-volatile soy methyl esters, elicited bite and irritation responses in 3 of the four subjects (1, 3 and 5), who had to terminate the test due to continued and increasing irritation.

For the test sample, the subjects again showed increased tolerance, and subjects 1, 2 and 5 did not find the irritation level to be continued or increasing, and completed the total test duration of 300 seconds without termination.

The results for this example show that ester solvent blends can have their tolerance levels enhanced by the addition of small concentrations of the tertiary amines.

EXAMPLE 6

This test was similar to that of Example 5; i.e., a solvent blend of ethyl lactate with soy methyl ester (Vertec™ Gold 50; methyl esters of soy oil fatty acids) was tested with a tertiary amines, which here was triethylamine at 2 percent w/w this solvent blend. The test subjects were 1, 3 and 5.

For the test sample, the subjects again showed increased tolerance, and subjects 1 and 5 did not find the irritation level to be continued or increasing. They completed the total test duration of 300 seconds without termination.

The results for this example show that ester solvent blends can have their tolerance levels enhanced by the addition of small concentrations of aliphatic tertiary amines.

EXAMPLE 7

In this test the solvent blend of ethyl lactate with other dibasic esters such as dimethyl succinate, adipate and glutarate, soy methyl ester (methyl esters of soy oil fatty acids), surfactants, and other minor components were tested with tertiary amines. This solvent blend (allowed U.S. patent application Ser. No. 09/544,756) is particularly suitable for printing machinery cleaning applications and is sold by Vertec Biosolvents under the trade name Ink Zapper™. The control was that solvent blend and the test sample was 5 percent w/w DMEA in that solvent blend. The test subjects were 1 and 4.

The control, even though it was a mixture of ethyl lactate with other esters and surfactants, elicited bite and irritation responses on both subjects, who had to terminate the test due to continued and increasing irritation.

For the test sample, the subjects again showed increased tolerance and both subjects did not find the irritation level to be continued or increasing, and completed the total test duration of 300 seconds without termination.

The results for this example show that ester solvent blends can have their tolerance levels enhanced by the addition of small concentrations of the tertiary amines.

Each of the patents and articles cited herein is incorporated by reference. The use of the article "a" or "an" is intended to include one or more.

The foregoing description and the examples are intended as illustrative and are not to be taken as limiting. Still other variations within the spirit and scope of this invention are possible and will readily present themselves to those skilled in the art.

What is claimed:

1. A solvent composition comprising a $C_1$–$C_4$ lactate ester and an odor-reducing amount of a tertiary amine having a boiling point at one atmosphere of about 80° C. to about 160° C., said composition (a) being substantially free of odor due to said tertiary amine as compared to the same composition without the tertiary amine, (b) exhibiting a reduced amount of odor due to said lactate ester, and (c) being a homogeneous liquid at zero degrees C.

2. The solvent composition according to claim 1 wherein said lactate ester comprises up to about 99 weight percent of said composition.

3. The solvent composition according to claim 1 wherein said lactate ester comprises about 20 to about 75 weight percent of said composition.

4. The solvent composition according to claim 3 further comprising about 10 to about 60 weight percent of a $C_1$–$C_4$ ester of a $C_{16}$–$C_{20}$ fatty acid having a melting point on minus 10° C. or less.

5. The solvent composition according to claim 1 wherein said lactate ester comprises about 30 to about 60 weight percent of said composition.

6. The solvent composition according to claim 5 further comprising about 30 to about 60 weight percent of a $C_1$–$C_4$ ester of a $C_{16}$–$C_{20}$ fatty acid having a melting point on minus 10° C. or less.

7. The solvent composition according to claim 1 wherein said lactate ester comprises about 40 to about 70 weight percent of said composition.

8. The solvent composition according to claim 7 further comprising about 1 to about 30 weight percent of a $C_1$–$C_4$ ester of a $C_{16}$–$C_{20}$ fatty acid having a melting point on minus 10° C. or less.

9. The solvent composition according to claim 1 wherein said tertiary amine has a boiling point of about 130° C. to about 160° C.

10. The solvent composition according to claim 1 wherein said tertiary amine is present in an amount of about 1 to about 25 percent of the ester present.

11. The solvent composition according to claim 1 wherein said lactate ester is ethyl lactate.

12. The solvent composition according to claim 1 wherein said tertiary amine is selected from the group consisting of N,N-dimethylethanolamine, N,N-diethylethanolamine, 1-dimethylamino-2-propanol, 3-dimethylamino-1-propanol, N-methyl morpholine, N-ethyl morpholine, triethylamine, tripropylamine, triiso-propylamine, 1-dimethylamino-2-propyne, triallylamine, 1-methylpyrrolidine, 1-ethylpyrrolidine, pyridine, 2-picoline, 3-picoline, 4-picoline, 2,3-lutidine, 2,4-lutidine, 2,5-lutidine, 2,6-lutidine, 3,4-lutidine and 3,5-lutidine.

13. A solvent composition comprising ethyl lactate and about 1 to about 25 percent w/w of a tertiary amine having a boiling point at one atmosphere of about 130° C. to about 160° C., said composition (a) being substantially free of odor due to said tertiary amine as compared to the same composition without the tertiary amine, (b) exhibiting a reduced amount of odor due to said lactate ester, and (c) being a homogeneous liquid at zero degrees C.

14. The solvent composition according to claim 13 wherein ethyl lactate comprises up to about 99 weight percent of said composition.

15. The solvent composition according to claim 13 wherein ethyl lactate comprises about 20 to about 75 weight percent of said composition.

16. The solvent composition according to claim 15 further comprising about 10 to about 60 weight percent of a $C_1$–$C_4$ ester of a $C_{16}$–$C_{20}$ fatty acid having a melting point on minus 10° C. or less.

17. The solvent composition according to claim 13 wherein ethyl lactate comprises about 30 to about 60 weight percent of said composition.

18. The solvent composition according to claim 17 further comprising about 30 to about 60 weight percent of a $C_1$–$C_4$ ester of a $C_{16}$–$C_{20}$ fatty acid having a melting point on minus 10° C. or less.

19. The solvent composition according to claim 13 wherein said lactate ester comprises about 40 to about 70 weight percent of said composition.

20. The solvent composition according to claim 19 further comprising about 1 to about 30 weight percent of a $C_1$–$C_4$ ester of a $C_{16}$–$C_{20}$ fatty acid having a melting point on minus 10° C. or less.

21. The solvent composition according to claim 12 wherein said tertiary amine is present in an amount of about 2 to about 10 percent w/w.

22. A solvent composition comprising ethyl lactate and about 2 to about 10 percent w/w of a tertiary amine having a boiling point at one atmosphere of about 130° C. to about 160° C., said composition (a) being substantially free of odor due to said tertiary amine as compared to the same composition without the tertiary amine, (b) exhibiting a reduced amount of odor due to said lactate ester, and (c) being a homogeneous liquid at zero degrees C.

23. The solvent composition according to claim 22 wherein said tertiary amine is aliphatic.

24. The solvent composition according to claim 23 wherein said tertiary amine is N,N-dimethylethanolamine or N,N-diethylethanolamine.

25. A method for reducing the odor of a $C_1$–$C_4$ lactate ester-containing solvent composition that comprises homogeneously admixing an odor-reducing amount of a tertiary amine having a boiling point at one atmosphere of about 80° C. to about 160° C. with said $C_1$–$C_4$ lactate ester-containing composition.

26. The method according to claim 25 wherein said lactate ester comprises up to about 99 weight percent of said composition.

27. The method according to claim 25 wherein said lactate ester comprises about 20 to about 75 weight percent of said composition.

28. The method according to claim 27 further comprising about 10 to about 60 weight percent of a $C_1$–$C_4$ ester of a $C_{16}$–$C_{20}$ fatty acid having a melting point on minus 10° C. or less.

29. The method according to claim 25 wherein said lactate ester comprises about 30 to about 60 weight percent of said composition.

30. The method according to claim 29 further comprising about 30 to about 60 weight percent of a $C_1$–$C_4$ ester of a $C_{16}$–$C_{20}$ fatty acid having a melting point on minus 10° C. or less.

31. The method according to claim 25 wherein said lactate ester comprises about 40 to about 70 weight percent of said composition.

32. The method according to claim 31 further comprising about 1 to about 30 weight percent of a $C_1$–$C_4$ ester of a $C_{16}$–$C_{20}$ fatty acid having a melting point on minus 10° C. or less.

33. The method according to claim 25 wherein said tertiary amine has a boiling point of about 130° C. to about 160° C.

34. The method according to claim 25 wherein said tertiary amine is present in an amount of about 1 to about 25 percent of the ester present.

35. The method according to claim 25 wherein said lactate ester is ethyl lactate.

36. The method according to claim 25 wherein said tertiary amine is selected from the group consisting of N,N-dimethylethanolamine, N,N-diethylethanolamine, 1-dimethylamino-2-propanol, 3-dimethylamino-1-propanol, N-methyl morpholine, N-ethyl morpholine, triethylamine, tripropylamine, triiso-propylamine, 1-dimethylamino-2-propyne, triallylamine, 1-methylpyrrolidine, 1-ethylpyrrolidine, pyridine, 2-picoline, 3-picoline, 4-picoline, 2,3-lutidine, 2,4-lutidine, 2,5-lutidine, 2,6-lutidine, 3,4-lutidine and 3,5-lutidine.

37. A method for reducing the odor of an ethyl lactate-containing solvent composition that comprises homogeneously admixing about 1 to about 25 percent w/w of a tertiary amine having a boiling point at one atmosphere of about 130° C. to about 160° C. with said ethyl lactate-containing composition.

38. The method according to claim 37 wherein said tertiary amine is present in an amount of about 2 to about 10 percent w/w.

39. The method according to claim 37 wherein said tertiary amine is N,N-dimethylethanolamine or N,N-diethylethanolamine.

* * * * *